United States Patent [19]

Sanfilippo

[11] Patent Number: 4,562,941

[45] Date of Patent: Jan. 7, 1986

[54] BULK PRODUCT DISPENSER

[76] Inventor: Jasper B. Sanfilippo, Box 367, Barrington Hills, Ill. 60010

[21] Appl. No.: 509,816

[22] Filed: Jun. 29, 1983

[51] Int. Cl.[4] ..... B67D 1/16; B67D 5/60; B67D 5/06

[52] U.S. Cl. ..... 222/108; 222/143; 222/181; 222/361; 222/517

[58] Field of Search ..... 222/564, 547, 511, 517, 222/457, 449, 346, 353, 354, 355, 361, 108, 143, 147, 181; 312/229, 270; 211/49.1

[56] References Cited

U.S. PATENT DOCUMENTS

| | | | |
|---|---|---|---|
| 352,195 | 11/1886 | Krag | 222/564 |
| 539,109 | 5/1895 | Wysor | 222/108 |
| 1,367,916 | 2/1921 | McKeig | 222/361 |
| 4,349,128 | 9/1982 | Sanfilippo | 222/129 |
| 4,440,322 | 4/1984 | Henry | 222/361 |

*Primary Examiner*—H. Grant Skaggs
*Assistant Examiner*—Andrew Jones
*Attorney, Agent, or Firm*—Fitch, Even, Tabin & Flannery

[57] ABSTRACT

A system of dispensers for bulk material is provided. The system includes a free-standing rack and a plurality of dispensers for bulk material having bottom panels and mounted on the rack. Each dispenser includes an enclosed container, an access door on the upper portion of the container, a spout connected to the bottom panel and defining an outlet in the bottom of the container. A downwardly directed taper is formed inside in its lower portion, the narrow portion of the taper being offset from the outlet. A passage extends generally longitudinally between and communicates with the narrow portion of the taper and the outlet. A feed slide assembly is slidably disposed on the inside of the bottom panel under the narrow portion of the taper and in the bottom of the passage. The feed slide assembly includes a knob and rod connected at one end for gripping to manually slide the assembly in to-and-fro movements longitudinally thereof and a spring in contact with the other end of the slide assembly. One end of the slide assembly forms a discharge gate for the outlet.

2 Claims, 4 Drawing Figures

BULK PRODUCT DISPENSER

This invention relates to supply containers for dispensing bulk materials and more particularly to supply containers having movable portions to assist in discharge of the contents.

Containers movably mounted on support racks and frames are widely used in containing and dispensing bulk materials in supply yards and on construction projects. Such containers are customarily sized to handle several yards of loose material, such as sand, gravel, rock, concrete mix, coal, grain and the like. Other dispensing containers are utilized for bulk products, such as tacks, small nuts, bolts and the like for use in various industries. Still others are utilized for dispensing bulk food products in, for example, retail grocery and food service stores where it is desirable to have the bulk material or product accessible to the consumer and at the same time to maintain sanitary conditions.

Various United States patents disclose dispensing bins in which a container is pivoted about a single axis. Still others disclose adjustable means for controlling an amount of material to be discharged from a container. Others disclose containers that include inner sloping lower surfaces and employ vibratory motion to induce movement of the contents toward discharge openings. Various dispensing devices also are known which dispense individual articles, one at a time.

U.S. Pat. No. 4,349,128, issued Sept. 14, 1982 to the same applicant as this application, discloses a container for dispensing bulk material that is movably mounted on a rack. A single discharge passage is provided in the container for the bulk material contents, and the container is movable generally longitudinally to a somewhat inclined position to assist in the movement of the bulk material toward the discharge passage. The container is mounted on a rack or framework which is free standing. The mounting devices translate a manually applied rearward thrust into a rocking or angular movement of the container to create more elevation of the container's rear end than of its front end during the rearward thrust of the rocking movement. The discharge passage is at the front of the container, and so when the rear end is elevated more than the front end, the bottom is inclined, and the bulk material tends to flow down the inclination toward the front end into the discharge passage. The container also can be rocked to and fro to agitate the product and move it toward the front when the supply of the product is low. A manually adjustable gate controls the flow of the product to the discharge opening.

Although the principles of that patented invention may be utilized in dispensing any of the earlier mentioned products, such as the various building materials and hardware, it is particularly advantageous in the dispensing of bulk food material, which may be any bulk food in the unpackaged state. A few examples of such bulk food are nuts, sunflower and squash seeds, health snack fruit mixes, beans, granola, banana chips, dried fruit, carob bits, raisins, toasted corn, sesame sticks, and various candies.

A conventional bulk food container has a lid removable from a wide mouth through which a scoop is inserted by hand to remove some of the product. The scoop is often overfilled, allowing excess product to fall from it as it is removed from the container. Furthermore, the very act of inserting an outside object, such as the scoop, and a person's hand within the container exposes the contents to contamination. There is also potential exposure to contamination from sneezes and coughs occurring near the open container. The container of the above-mentioned patent, however, overcomes these disadvantages and provides for a controllably dispensed product in an improved sanitary environment. Nonetheless, the construction of the device does not completely overcome consumer carelessness in dropping small amounts of the bulk food material around the environs, creating less than a desirable condition in the sales area. Moreover, the manner in which the amount of the dispensed product is controlled requires more careful attention from the consumers than many are willing to give. Also, as a means of restricting access to the contents, the lid for the container as described in the aforementioned patent is located in the rear of the device. Thus, in a bank of such devices on a frame, either an access aisle in the rear, which takes valuable space, or a cumbersome maneuvering of the entire rack is required to obtain access for replenishing.

The earlier mentioned conventional containers also had a further disadvantage in that some of the product would still remain in the bottom at the time the supply in the container was replenished. After several times of replenishing, this bottom material would undesirably age and not be fresh. To overcome this, the invention of the aforementioned patent provided for a natural rotation of the product to maintain its freshness. It is desirable, of course, to keep the automatic rotation of the product as a feature of this invention.

Accordingly, it is an object of this invention to provide a dispenser for bulk material constructed to minimize scattering of product while it is being dispensed.

It is a further object of this invention to provide a dispenser for bulk material constructed so as to dispense the product without exposing the product to contamination.

It is yet another object of this invention to provide a dispenser for bulk material constructed to minimize the effects of product mishandling and carelessness by consumers during dispensing.

It is yet another object of this invention to provide a dispenser for bulk material constructed so that the consumer can successfully operate the dispenser upon reading only a few simple instructions.

Other objects and advantages will become apparent upon reading the following detailed description in conjunction with the attached drawings in which.

Briefly, there is provided in accordance with this invention a container or bin for dispensing bulk material that is mounted on a rack or framework and has provided therein a hand-controlled feed slide for dispensing controlled amounts of the bulk material. A single outlet spout is provided for discharging or vending the contents, and the container is stationary on the rack.

The rack or framework is freestanding and includes a base and a plurality of vertical members rising from the base and interconnected by a plurality of horizontal members. The horizontal members provide support for each container. The containers are mounted adjacent each other to form a row or tier, and the rack is arranged to provide a plurality or stack of such tiers.

Each container is stationary, even during dispensing. A manually actuated feed slide is provided in each one for discharging the product.

For purposes of this description, the word "dispenser" refers to a container which includes manually operable means for assisting in the discharge of a measured amount of a contained prouduct at the outlet of the container.

Preferably, the container is constructed with a funnel-like spout at its outlet or discharge end. The inside bottom of the container includes a pair of sloping panels that create a taper merging to a passage that leads into the top of the discharge port or spout around which a bag or sack may be placed to receive the discharged product. An access door is provided at the front of the container overhead of the discharge spout for adding new product to replenish the supply. A system of such containers includes a shelf or tray below each discharge spout which also forms a security bar against the unauthorized opening of the access doors in the containers immediately below. A knob at the end of a protruding control rod provides for the manual control of a feed slide, the manually operable means for assisting dispensing from the container.

Figure 1:
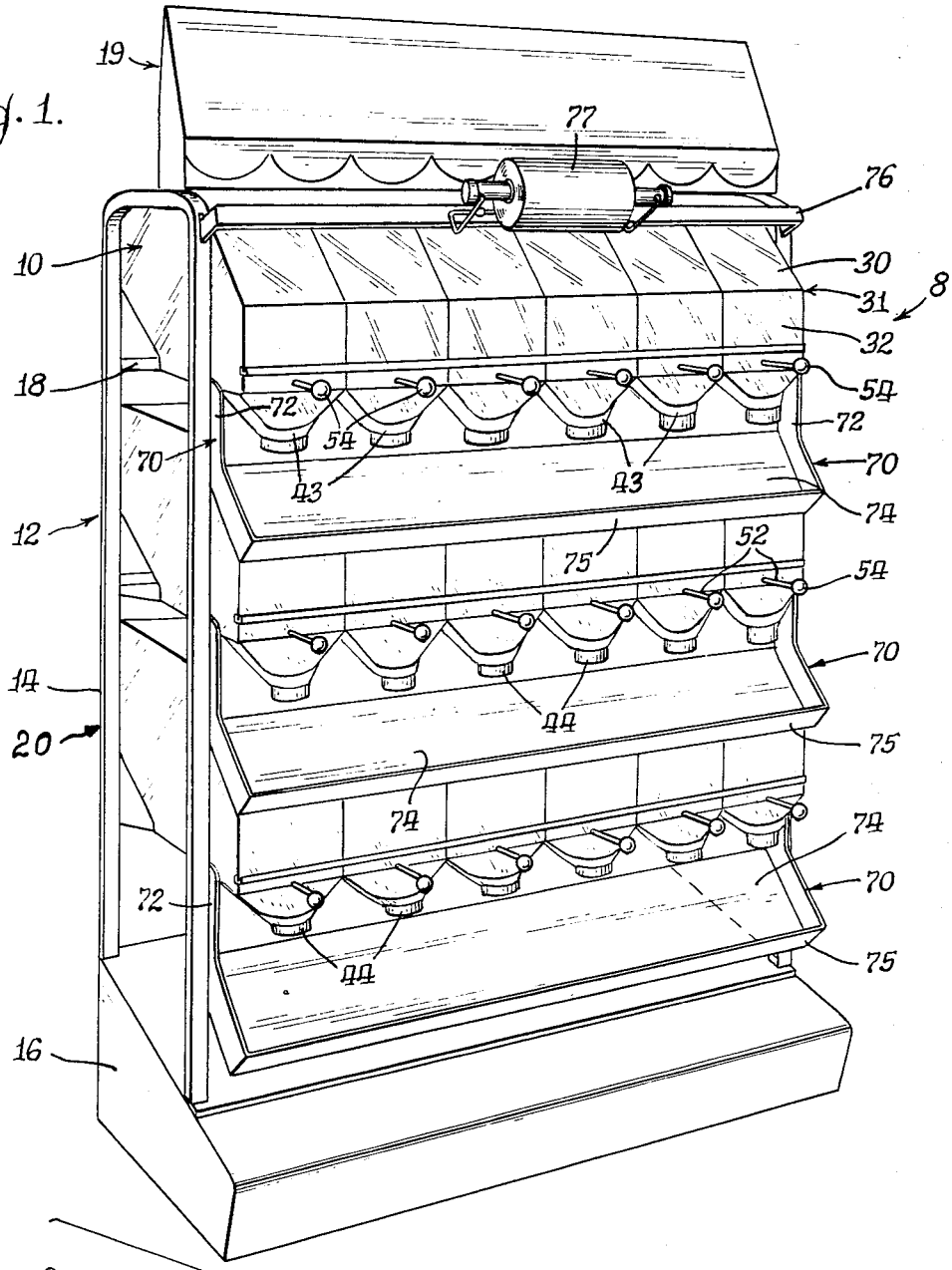
FIG. 1 is a perspective view of a system of dispensers for bulk materials mounted in a bank and constructed in accordance with the principles of this invention.

More specifically and with reference to FIG. 1, there is shown a system or bank 8 of dispensers 10 for bulk material constructed and mounted in accordance with the principles of this invention. The dispensers are all supported on a free-standing rack 12 which includes a plurality of upright or vertical members 14. These upright members are suitably connected to a base 16. Transverse members 18 are joined to the upright members 14 and are so interconnected as to form a unitized framework 20 mounted on the base 16. The various members of the rack 12 may be made of any suitable material, such as tubulator steel or aluminum having a square cross-section. The transverse members may be joined to the vertical members, and the vertical members to the base in any suitable manner, such as by welding or by bolting or other suitable fastening means.

Although the principles of this invention may find application in dispensers for most any kind of bulk material, they are particularly applicable and advantageous for bulk food in the unpackaged state, as mentioned earlier. Such dispensing may be in a retail food store where it is desirable to attractively display and even highlight the bulk food products. Accordingly, an attractive canopy 19 may be attached to the rack 12 in a suitable manner overhead of the system of dispensers. Suitable decorative design and other indicia may be provided on this canopy to attract attention ahd otherwise advertise the products.

The purpose of the free-standing rack 12 is to provide support for the plurality of dispensers. It is contemplated that a flowable bulk food product will be contained in each dispenser for dispensing at a retail food convenience center. This kind of bulk food dispensing permits the consumer to obtain as much of the product as desired and pay for it by weight, which is preferable to consumers who may not want to be bound by the fixed weights of pre-packaged products. Of course, bulk food dispensing is not new. As mentioned previously, large-mouthed containers having covers, wherein the product is removed by a hand scoop, have long been in use. The probability of contamination, however, is ever present. Moreover, there is also the likelihood that when the supply is replenished, the fresh product is poured in on top of the old, leaving the older product to continue its aging process in the bottom of the container. Other more recent dispensers have been constructed to avoid the disadvantage of the aging product, but they have generally been known as "mess makers" in the hands of careless consumers.

In accordance with this invention, the dispenser 10 includes a container 21 which is provided with a vertical front face. This front face may contain a label bearing simple instructions for operation. For example, one such label has been printed which reads as follows:

INSTRUCTIONS

1. Hold bag under spout
2. Push knob in and out as many times as needed

In contrast to the device of the invention of the earlier mentioned U.S. Pat. No. 4,349,128 which provides means for movably mounting the container to agitate the product and enhance its flow toward the outlet, the dispenser 10 of this invention is mounted in a stationary position with the moving of the product within being brought about by an internal movable device shown as a feed slide 22 in FIGS. 3 and 4. The feed slide 22, however, operates in the container 21 as best seen in FIG. 4.

Figure 2:
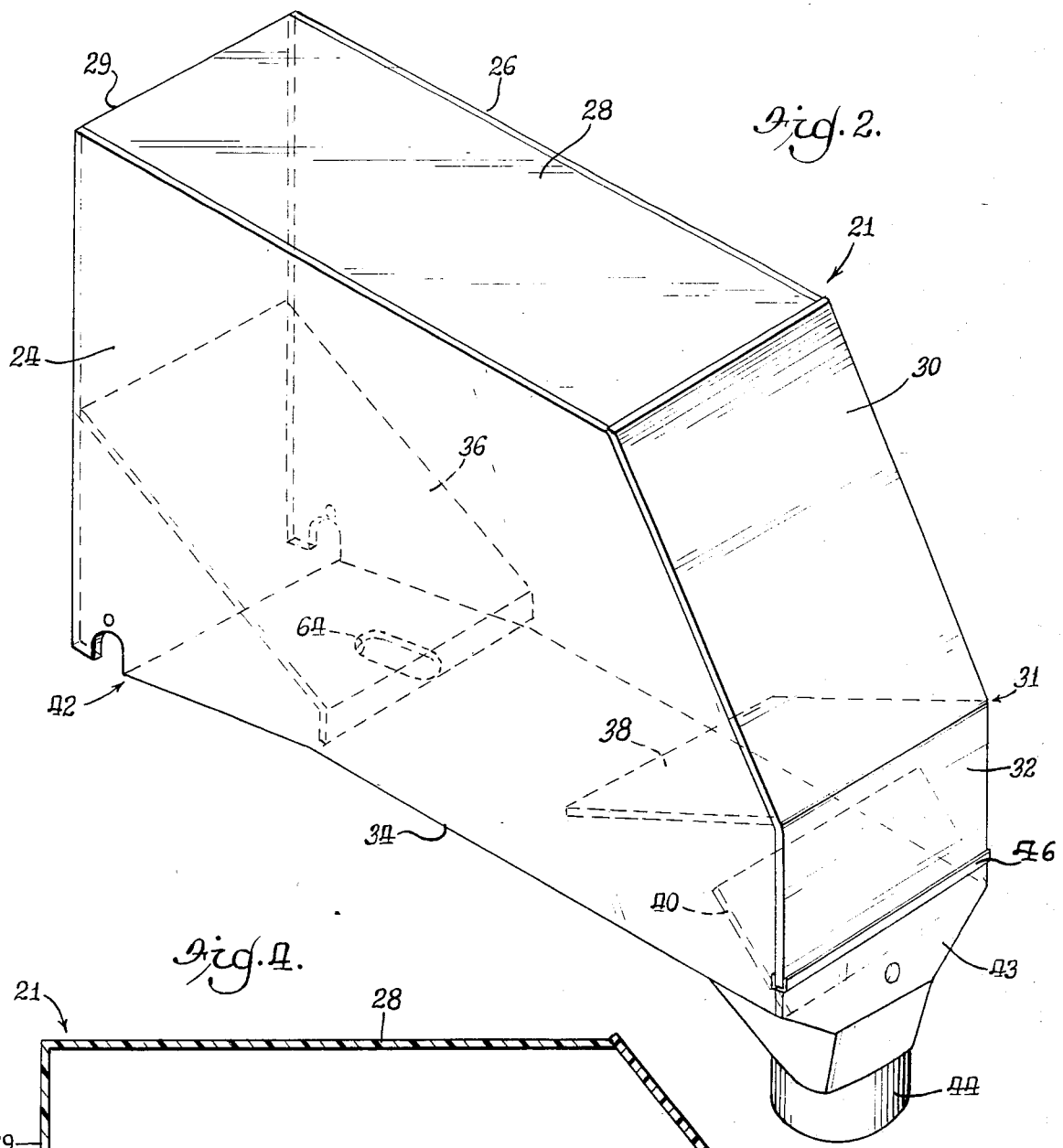
FIG. 2 is a perspective view in detail of a dispenser for use in the system shown in FIG. 1.

Referring now to FIG. 2, it will be seen that the container 21 of the illustrated embodiment is in a form that differs considerably from a typical enclosure in which the various faces are flat and intersect one another at right angles. In this illustrated embodiment, the container 21 includes flat left and right sides 24 and 26 respectively, (as viewed from the front in FIG. 2), a flat top 28, a back panel 29, an inclined front face 30, an upright adjacent front face 32, a flat base panel 34, a rear taper panel 36, a front taper panel 38, a baffle 40, and a rear mounting extension 42. The side panels 24 and 26 along with the flat base panel 34 and the upright front face 32 terminate at the lower right in a funnel-like spout 43 that defines an opening or outlet 44. The funnel-like spout changes in form from a rectangular mouth at its top to a circular form defining the outlet.

The container 21 preferably is made of clear acrylic. This material affords clear vision of the contents, and the material acts as a lubricant, which along with the oils in the various products, eliminates the need for any other lubrication. As may be best seen in FIG. 4, the inclined front face 30 is integral with the vertical front face 32 to form a one-piece removable cover 31 for the container 21. A channel bracket 46 is provided as a mounting base for the one-piece cover. Thus, this inclined panel 30 along with the front face 32 becomes an access door 31. As will be seen later, access to the interior through this combination of panels 30 and 32 may be obtained only by removing a tray or other locking mechanism (in the instance of the top tier of dispensers).

Figure 4:
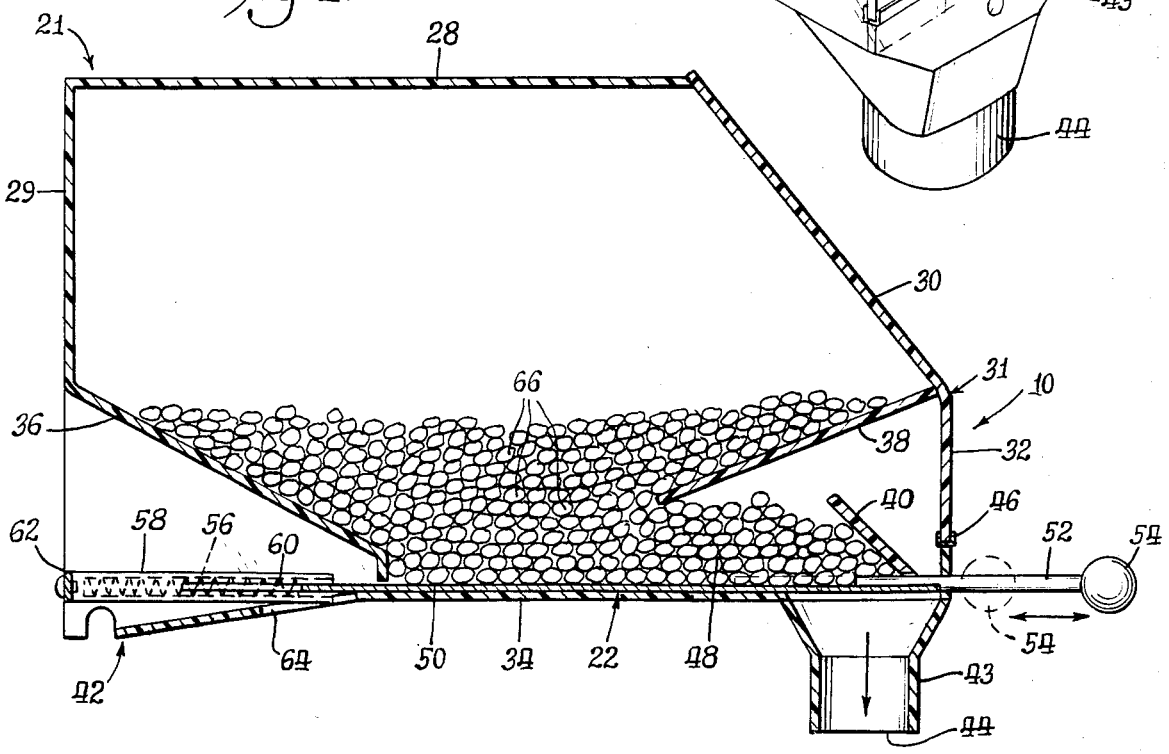
FIG. 4 is a side sectional view of a complete dispenser of the invention.

FIG. 4 also illustrates particles 66 representing a product within the container. This product, of course, is placed in the container through the access door 31 combination of panels 30 and 32. The general path that the product follows is determined by the slope and position of the taper panels 36 and 38. It will be noted that the panel 38 terminates at its lower end at a point that is elevated above the termination of the opposing taper panel 36. A baffle 40 is located at the front of the container and is inclined downwardly to the mouth of the funnel-like spout 43. As will be seen in more detail hereinafter in connection with the operation of the feed slide, a feed passage 48 is defined generally between the lower edge of the taper panel 38, the upper edge of the baffle 40 and the flat base panel 34. The height of this passage contributes to the control of the product in the feedleg. Thus, a high passage 48 would allow the product to flow relatively freely through this leg, whereas a very low passage would become restrictive to the movement of the product. An example of a construction of this passage has been built in which the passage 48 is approximately 175 mm long and approximately 35 mm high. The width of the container in that example of construction was approximately 190 mm; the depth, approximately 600 mm; and the height, approximately 380 mm.

Figure 3:
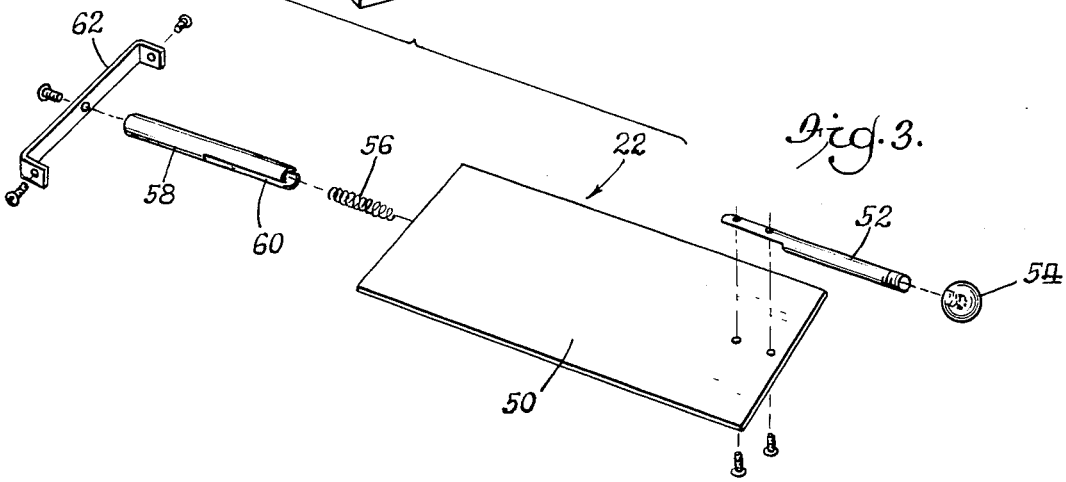
FIG. 3 is an exploded view illustrating a feed slide assembly for use in the dispensers of FIGS. 1 and 2.

The device that both controls the outlet opening and moves the product to exit through the opening is the feed slide 22. Reference is made to FIG. 3 for a detailed description of the feed slide 22. This feed slide includes an operating plate 50, which preferably is made of a flat metal, such as 16 gauge stainless steel. At the front end of the plate (to the right as viewed in FIG. 3) is a control rod 52 on the outer end of which is mounted a knob 54. The left end of the control rod if flattened to fit over the end of the plate 50 so as to be secured thereto. Securing may be by any suitable means, such as by fasteners or by welding. In the illustrated embodiment, the securing is accomplished by a pair of holes through the plate 50 and a pair of flathead screws securing the rod to the plate through the holes. The outer end of the control rod 52 preferably is threaded to receive the knob 54. The control rod preferably is a plated steel rod.

At the other end of the plate 50 is a spring 56 and a tube 58. The tube 58 receives the spring 56 and also contains a slit 60 that extends from one end for approximately one half the length of the tube 58. The slit 60 is wide enough to receive the plate 50 in the assembled condition. A bracket 62 is used to mount the spring tube 58. The bracket 62 may contain mounting means such as ears at both ends bent at right angles to the length of the bracket to receive mounting screws. A center hole is provided in the bracket to receive a mounting screw which secures the tube to the bracket. At the end opposite the slit, the spring tube is solid and is provided with a threaded hole to receive the mounted screw through the bracket.

Returning to FIG. 4, the feed slide assembly is slidably mounted inside of the container 21 on top of the flat base panel 34. The bracket 62 is mounted on the inside of the mounting extension 42 between the side panels 24 and 26 to mount the spring tube assembly 58. It will be noted that a spring tube clearance hole 64 is provided in the bottom panel (not numbered) of the mounting extension 42 to permit clearance for the mounting of the spring tube 58.

The operation of the feed slide 22 is best described in connection with FIG. 4. The feed slide 22 is mounted internally of the container 21 longitudinally of the flat base panel 34 so that the plate 50 is in sliding relationship therewith. Movement in a direction rearwardly of the container 21 (to the left as viewed in FIG. 4) is accomplished by a rearward thrust manually applied to the knob 54. This thrust moves the rear end of the slide in the slit 60 of the tube 58 and the plate 50 along the base 34. Inside the tube 58 the spring 56 acts as a shock absorber as far as the rearward thrust of the feed slide is concerned, and as a return thrust device to urge the feed slide back to its home position when the force applied to the knob 54 is removed. In this back and forth movement of the feed slide, two principal objects are accomplished. The first is that the right end of the feed slide acts as a trap door or gate to close the mouth of the spout 43. Thus, when the feed slide 22 is in the normal or closed position, the mouth of the spout 43 is closed. This completely shuts off the product from the outlet 44. Conversely, when a manual force is applied against the knob 54 to move the slide to the rear, the mouth of the spout 43 is opened, and any bulk material is free to spill down into the funnel-like spout and out of the outlet 44.

The second object accomplished by the feed slide 22 is to provide locomotion for moving the particles of the food product into the feed leg 48 and spout and out the outlet. It can be seen in FIG. 4 that as a force is applied to the knob 54 so as to move the feed slide 22 to the left, the movement of the feed slide will be against the urging of the spring 56. At the same time, the feed slide itself moves underneath the edge of the rear taper panel 36. This taper panel terminates at a point just overhead of the flat base panel 34 sufficiently to clear the feed slide 22 while at the same time not permitting movement of any particles behind the taper panel.

To better illustrate this, as product is introduced into the container 21 by removing the unitized combination of panels 30 and 32 from its cradle in the channel bracket 46. Thus the particles 66 are introduced into the container. Gravity, of course, carries the particles downwardly into the zone intermediate the inward terminations of the taper panels 36 and 38. As the feed slide 22 is operated to and fro, it can be seen that the food particles will tend to ride with the slide to the right but will be blocked from moving to the left (i.e., the rear) because of the wall formed by a bent vertical portion of the rear panel 36. The food particles pile against one another and against the wall and consequently only a forward movement (with respect to the dispenser) is possible. Such forward movement of the particles is possible because any that are found in the nose or front end of the feed leg 48 immediately fall into the funnel-like chute 43 when the feed slide 22 is pushed to the rear. This vacates the area in the front end of the feed leg 48 and allows more food particles to ride toward the front against the baffle 40 upon the closing of the feed slide 22. The movement of such particles forward tends to create a vacancy in the rear end of the line of particles in the passage. This vacancy is filled again by gravity from the overhead supply in the bin. Thus a closed line again is formed and as soon as the slide is pushed rearwardly, the slide moves beneath the particles while the particles only tend to compact in that rearward thrust, the frontmost particles falling into the spout 43 through the open gate. Preferably, the container 22 is mounted so that the base has an approximately 2° incline toward the rear to enhance the movement of the product toward the discharge gate.

The assembled container 21, together with the assembled feed slide 22 form the dispenser 10. Preferably, a plurality of such dispensers are mounted in close proximity of each other to provide a system of varied bulk products from which to choose. Such a system 8 is provided as shown in FIG. 1. Each of the dispensers 10 may be of the same size, shape and construction. The pairs of cross members 18 are provided in the free-standing rack 12 as mounting supports for each row of the dispensers 10. As may be seen in FIGS. 2 and 4, the rear end mounting extension 42 of the dispenser is formed to mount over the cross member 18, and the front end of the dispenser merely lays across the front cross member 18. A plurality of trays 70 are provided to catch any spill from the outlets 44 of the dispensers. These trays are constructed such that they are inclined downwardly and forwardly below a row of aligned spouts 43, but they also contain mounting arms 72 at their opposite ends. The mounting arms 72 extend generally vertically with respect to the rack 12. The trays are pivotally hung by these mounting arms from associated front cross member 18 of the rack 12. Preferably, the trays also are made of clear acrylic.

The trays serve two principal functions. The first is that they are physically located below a side-by-side alignment of spouts 43 to catch any spilled product. The second is that they act as a security device to prevent the public from having easy access to the interiors of the containers. As will be observed in FIG. 1, each tray has an inclined bottom 74 that is surrounded on the front ends by an upright running edge 75. When the tray is hung in position, the bottom 74 is inclined at the same angle as the panel 30 of the door of the container immediately below the tray. Thus, the tray mounts over the access doors of the bins mounted immediately below. The tray may actually rest on the inclined surface portion of the doors, but irrespective of whether it touches, the tray blocks access to the removable door panel units. Thus, before material can be added to any of the bins, the trays must first be removed. Such removal requires such a deliberate effort that it would be difficult for a member of the general public to remove the tray without being detected.

The bottom most tray in the tier of trays serves only to catch spilled material from the spouts. The uppermost row of dispensers 10 have no tray above them, but a locking bar 76 is removably mounted on the rack to block the removal of the access doors or panels. As indicated in FIG. 1, this locking bar 76 may also be used as a support for roll stock 77, of, for example, plastic bags that would be used by the consumer in purchasing any of the vended products.

An advantage of this system of dispensers 8 is that the various products to be vended are available in view of the purchaser, who then has an easy task of making the selection. The consumer has control of the portion of the product to be vended by moving the knob back as far as the physical limits permit of the dispenser containing the desired product. The feed and speed of the feed of the vended product is under the control of the consumer, and this is controlled by the vigorousness of the manual activity on the knob. Should the consumer be over zealous or otherwise careless and drop part of the vended product, the product falls into a tray where it can be easily cleaned up by store personnel. The construction allows authorized personnel to dismantle the trays sufficiently to gain access to any of the dispensers. A typical bank of dispensers 8 might be that shown in FIG. 1, i.e., a plurality of dispensers 10 arranged with six side by side in tiers of three high on a single free-standing rack 12.

Thus there has been described in accordance with this invention a system or bank of dispensers comprising a plurality of dispensing bins for bulk material each dispensing bin including an enclosed container having an access door on the upper portion of the container, a spout defining an outlet in the bottom of the container, a taper formed by lower panels inside the container, the small end of the taper being offset from the outlet but feeding into a passageway that extends generally horizontally between the small end of the taper and the outlet. Each container includes a feed slide assembly slidably disposed on the inside of the bottom panel of the container under the small end of the taper and in the bottom of the passage. The feed slide assembly includes means connected at one end for manual gripping to slide the assembly in in-and-out movements longitudinally of the assembly and spring means at the other end.

While the invention has been described in connection with a preferred embodiment, alternative, modifications and variations may be apparent to those skilled in the art in view of the foregoing description. Accordingly, it is intended to embrace all such alternatives, modifications and variations as fall within the spirit and scope of the appended claims.

What is claimed is:

1. A system of dispensers for bulk material, comprising a free-standing rack;

a plurality of dispensers for bulk food products, said dispensers having bottom panels and being mounted on the free-standing rack and arranged in a plurality of tiers of rows of aligned, side-by-side units, each dispenser being made of a transparent material and including an enclosed container, an access door on the upper portion of the container, a spout having a mouth and connected to the bottom panel and defining an outlet in the bottom of the container, a gate over the mouth of said outlet, a taper formed inside the container in the lower portion thereof, the taper having a narrow portion directed downwardly, the narrow portion being offset from the outlet, a passage extending generally longitudinally between and communicating with the narrow portion of the taper and the outlet, and a planar feed slide assembly slidably disposed on the inside of the bottom panel under the narrow portion of the taper and in the bottom of the passage, said feed slide assembly including gripping means connected at one end for manually sliding said assembly in to-and-fro movements longitudinally thereof and spring means at the other end of the slide assembly, one end of said slide assembly forming said discharge gate over the mouth of said outlet, whereby the feed slide assembly can effect both movement of bulk material in the container toward the outlet and discharge thereof in the outlet in variable, controlled amounts directly by manual operation; and a plurality of trays mounted on said rack, one tray extending across each row of dispensers below the outlets thereof, said access door including an inclined face and a vertical front face on the front end of each dispenser, the discharge spout being located at the front end of each container, and each of said trays being inclined at substantially the same angle as the inclined front face of the access door and being disposed along the top side of the access doors of any dispensers mounted beneath the tray to block the opening of the doors below the tray.

2. A system of dispensers in accordance with claim 1 further comprising a bar removably mounted on said rack in its upper front portion and extending across the access doors of the dispensers in the top tier to block the opening of those doors.

* * * * *

UNITED STATES PATENT AND TRADEMARK OFFICE

CERTIFICATE OF CORRECTION

PATENT NO. : 4,562,941

DATED : January 7, 1986

INVENTOR(S) : Jasper B. Sanfilippo

It is certified that error appears in the above-identified patent and that said Letters Patent is hereby corrected as shown below:

Col. 5, Line 25, change "if" to --is--.

Col. 6, Line 26, change "as" to --a--.

Signed and Sealed this

*Twentieth* Day of *May 1986*

[SEAL]

*Attest:*

DONALD J. QUIGG

*Attesting Officer*

*Commissioner of Patents and Trademarks*